United States Patent [19]

Görike

[11] 4,338,489

[45] Jul. 6, 1982

[54] HEADPHONE CONSTRUCTION

[75] Inventor: Rudolf Görike, Vienna, Austria

[73] Assignee: AKG Akustische u. Kino-Geräte Gesellschaft m.b.H., Austria

[21] Appl. No.: 119,497

[22] Filed: Feb. 7, 1980

[30] Foreign Application Priority Data

Feb. 12, 1979 [AT] Austria ..... 1029/79

[51] Int. Cl.[3] ..... H04R 3/00; H04R 9/06; H04R 19/04

[52] U.S. Cl. ..... 179/1 R; 179/111 R; 179/115.5 PV; 179/156 R; 179/182 R

[58] Field of Search ..... 179/156 R, 111 R, 115.5 PV, 179/182 R, 182 A, 1 R

[56] References Cited

U.S. PATENT DOCUMENTS

| | | | |
|---|---|---|---|
| 1,983,377 | 12/1934 | Kellogg | 179/111 R |
| 3,008,013 | 11/1961 | Williamson et al. | 179/111 R |
| 3,136,867 | 6/1964 | Brettell | 179/111 R |
| 3,674,946 | 7/1972 | Winey | 179/115.5 PV |
| 3,796,840 | 3/1974 | Ohta | 179/156 R |

FOREIGN PATENT DOCUMENTS

| | | | |
|---|---|---|---|
| 2335201 | 6/1975 | Fed. Rep. of Germany | 179/156 R |
| 1454121 | 9/1966 | France | 179/111 R |
| 50117531 | 3/1977 | Japan | 179/11 R |

*Primary Examiner*—George G. Stellar
*Attorney, Agent, or Firm*—McGlew and Tuttle

[57] ABSTRACT

In a diaphragm arrangement for electroacoustical transducers, in particular for headsets, one or more diaphragms lie in one plane which extends in the immediate proximity of the user's external ear and preferably parallel to the tangential plane of the user's external ear. In order to enable the use of the headset to better discern direction and distance by hearing, the diaphragm is divided into several coherent, preferably stripshaped sections or composed of several, preferably stripshaped part diaphragms which are adjacent or follow each other in that particular direction in which the user's ear is to locate the direction of sound incidence in the use position. Each diaphragm section or each part diaphragm is provided with a separate drive element or system, there being provided, at least between drive elements or systems of two diaphragm sections or part diaphragms following each other in the sense of the required direction of sound incidence, an element delaying the transmit time of the signals and/or a delay circuit.

14 Claims, 16 Drawing Figures

HEADPHONE CONSTRUCTION

FIELD AND BACKGROUND OF THE INVENTION

The invention relates to a membrane arrangement for electroacoustical transducers, in particular for headsets, in which one or more diaphragms lie in one plane when the transducers are in a use position, which plane extends in the immediate proximity of the user's external ear and preferably parallel to the tangential plane of the ear.

Headsets of this design are generally preferred at present. They are characterized by their good frequency response and small distortion factor. It was not yet possible however, despite all efforts, to eliminate another deficiency inherent in most headsets generally, namely the fact that direction and distance discernment by hearing with headsets usually does not conform to reality. Generally, a disturbing effect becomes noticeable in that the acoustic event does not become audible in front of the headset user as it should be, but more or less vaguely on the side, in the back, or raised out of the horizontal plane (elevation). This is attributable to the fact that when listening with headsets, the signals at the eardrum do not coincide with those perceived in actual live and free listening. Even slight deviations result in incorrect sound location fixing in the ear.

Essentially, the position of the diaphragm of a headset, relative to the natural direction of incidence of the sound waves is decisive, for when the headset is worn, the diaphragm is usually in a plane extending roughly parallel to the external ear so that the sound waves are radiated by the headset diaphragm approximately perpendicularly to the natural direction of incidence. To remedy this deficiency, it has already been suggested to arrange a diaphragm in such a way in the headset that the diaphragm is positioned, when in use, about perpendicular to the lateral direction of incidence, and in front of the user's external ear. Such an arrangement, however, has the disadvantage that the coupling space between diaphragm and ear becomes relatively large, which has an unfavorable effect at least on the efficiency of the headset and results in a loss in certain high frequency ranges.

The physical processes in sound transmission from a diaphragm to the ear with the interposition of a coupling space are expressed in the following theorem:

In the low frequency range from about 50 to 300 Hz the diaphragm mass and the restoring force due to the radial tension or the retention system furnishes a resonance which is increased to 1000 to 3000 Hz by the restoring force of the coupling space. Below this frequency range the diaphragm operates elastically inhibited, i.e. with constant amplitude at constant driving force, whereby frequency-dependent signals originate at the eardrum, as the external ear has influence in this range. Above this range, the amplitude of the diaphragm would drop, were it not for the directional radiation due to the size of the diaphragm. With a diaphragm area of 35 to 40 $cm^2$, a mass of about 0.015 g, and a small coupling space, into which the outer ear projects freely, the transition is gapless.

SUMMARY OF THE INVENTION

It is an object of the present invention to create a diaphragm arrangement for electroacoustical transducers, in particular for headsets, which enables the user of a headset to hear and perceive direction and distance better. The basic concept of the invention is to drive a diaphragm or juxtaposed part diaphragms successively with a delay so that, in conjunction with undisturbed external ear action, those audio signals are generated by the device correspond to sounds which occur when listening freely, particularly when the sound comes from the front. The problem is solved in concrete form in that the diaphragm is divided into several coherent, preferably stripshaped sections or is compsed of several, preferably stripshaped part diaphragms which are adjacent to or succeed each other in that particular direction in which with the device, the ear is to locate the direction of sound incidence, and each diaphragm section or each part diaphragm is provided with a separate drive element system, there being provided, at least between drive elements or systems of two diaphragm sections or part diaphragms following each other in the sense of the required direction of incident sound, an element for delaying the transit time of the signal and/or a delay circuit.

The diaphragm arrangement according to the invention makes it possible to keep the coupling space between ear and diaphragm small on the one hand, and to drive the successive diaphragm sections or the successive part diaphragms in a time differentiated manner, on the other hand, so that the transmitted acoustic event is fed to the ear in a manner corresponding to a frontal direction of incidence, of the live sound, despite the diaphragm plane being roughly parallel to the external ear plane. The time delay difference between the individual, successive sections or part diaphragms are proportioned so that the acoustic event reproduced by the headset, i.e. the sound energies emitted by the sections or part diaphragms, correspond to those occurring according to the Huygen-Fresnel principle at the outer ear when listening to the actual sound freely. This principle states that every point of any wave field can be conceived as a spherical wave. Transferred to the headset diaphragm this means that the invidividual diaphragm sections or part diaphragms transmit time-delayed sound waves, which is accomplished in the invention in that the sound radiation from one diaphragm section to the other or from one part diaphragm to the other is delayed according to the propagation time in the free or actual sound field.

Assuming, in frontal sound incidence, the distance from the front to the rear edge of the external ear to be 5 cm, the resultant propagation time across the ear is about 0.14 ms. By splitting the diaphragm into, for example, four stripshaped sections or part diaphragms, the time delay between two successive sections or part diaphragms is between 0.035 ms and 0.07 ms. Any number of diaphragm sections or part diaphragm, of course, is possible, each driven with corresponding delay. For economic and mechanical reasons, however, it is expedient to restrict the number of diaphragm sections or part diaphragms to four or five with at least two being used.

To obtain the small delay differences between the successive diaphragm sections or part diaphragms the known modules of the RC-type or the RL-type are already sufficient. Of course, other ways and means of group time delay may also be used, such as those known from analog technology and also from digital technology (e.g. the bucket chain circuit). If applicable, the signal amplitude can be influenced at the same time, and a predetermined frequency response can also be given to the delay element or delay circuit to reproduce actual directional sound as closely as possible. But of essential advantage for achieving the effect according to the invention, namely the possibility of "frontal locating" when using headsets is the division of the diaphragm area into several parallel, e.g. vertical in use position, sections or strips successively driven with time-delay according to the propagation of the sound wave in the free sound field. Either the orthodynamic or the electrostatic principle is particularly well suited as a drive system, but moving coil systems serve the purpose also. Although the problem of "frontal locating" when listening to acoustic events with a headset is the primary objective of the invention, the proposed arrangement can also be utilized for other acoustic effects such as when listening to acoustic events transmitted quadrophonically where the purpose is to simulate, in the headset, the sound effects on the external ear which are direction-dependent when listening freely or to live sound. By time-variable sound radiation of the individual diaphragm sections or part diaphragms, it is possible to vary almost arbitrarily the direction of sound wave incidence in the headset, or to simulate simultaneously correspondingly different directions of incidence of different acoustic events.

So that the diaphragm arrangement according to the invention can become fully effective, it is assumed that neither it nor any surfaces in its immediate vicinity are in a position to reflect sound. For, as has already been explained in the Austrian patent applications 669/77 and 6285/77, surfaces as small as $cm^2$, in the vicinity of the ear entrance or 2 $cm^2$ in the area of the external ear, will cause linear signal distortions at the eardrum which will not only falsify the sound fixation, but also cause the "in the head localization effect". To prevent such undesired effects, an extremely thin diaphragm material of a thickness from 20 to $\mu m$ is used in the invention, and the diaphragm or the part diaphragms are mechanically clamped only under as little tension as required to prevent the material from forming waves. In addition, very low natural resonances, ranging between 50 to 200 Hz, can be realized in this manner. Additional measures known in the headset industry, such as the use of passive diaphragms to linearize the frequency response, the application of friction resistance in the area of the diaphragm surface may, if this creates no sound-reflecting surfaces, be combined without difficulty with the diaphragm arrangement according to the invention, and this may, under certain circumstances, even intensify the effect according to the invention.

Accordingly, an object of the present invention is to provide an electroacoustic transducer particularly for a headphone or headset comprising means defining a diaphragm with a membrane extending in a plane and positionable in close proximity to the external ear of the user, the means defining a diaphragm being divided into a plurality of adjacent coherent sections disposed in succession, each energizable by an audio signal, and means connected to the sections for applying the audio signal to the sections with the signal applied to a succeeding one of the sections with a delay with respect to the signal applied to a previous one of the section.

A further object of the present invention is to provide an electroacoustic transducer which is simple in design, rugged in construction and economical to manufacture.

A further object of the present invention is to provide a method of reproducing a sound having a directional quality with an audio signal which has a directional quality comprising, activating a first diaphragm section of an electroacoustic transducer adjacent a part of a user's ear with an audio signal, and activating a second diaphragm section of the electroacoustic transducer adjacent the first diaphragm section and adjacent a second part of the user's ear which is adjacent the first part of the user's ear with the audio signal which has been delayed by a selected time.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
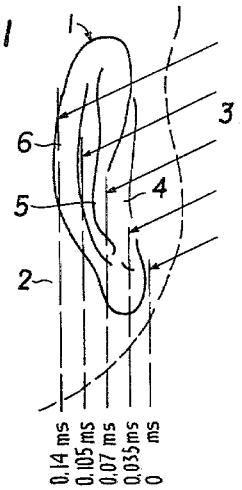
FIG. 1 is an exonometric projection of a human ear on the portion of a head of a user of the headset showing the travel direction of a sound wave in time as it passes various parts of the ear.
Figure 2:
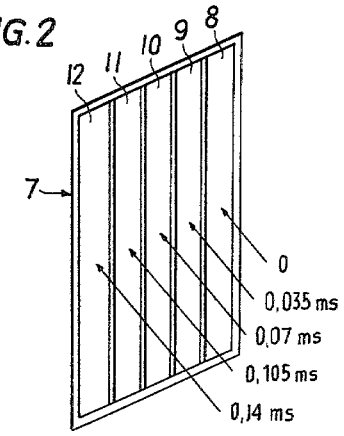
FIG. 2 is a schematic perceptive view of a diaphragm according to the invention which is divided into strip-shaped sections.

A planar sound wave front coming from the line or direction of vision of a user, reaches the front 4 of the user's external ear 1, shown in FIG. 1 in exonometric projection and forming part of the user's head 2. According to the previously mentioned Hygens-Fresnel principle, therefore, a spherical wave is released at the front edge 4 of the ear. The wave front propagates and generates another spherical wave at an ear part 5 which is reached in the propagation direction of the sound wave about 0.035 ms later. This process continues over the entire width of the ear, and after about 0.14 ms, the sound wave has reached the rear edge 6 of the external ear. Now, in order to simulate in the ear an at least similar process when reproducing an acoustical event by means of a headset, a diaphragm, such as one divided into stripshaped sections as shown in FIG. 2, is used according to the invention. Each one of the sections 8 to 12 of the diaphragm 7 has its own drive system. The system assigned to the first diaphragm section 8, or the one located in the front position when the device is in use receives the signal without delay, whereas the second section 9 already receives the signal delayed by 0.035 ms, which time difference is also provided between it and the next section 10. The signal transmission is also delayed in the same manner between the sections 10, 11 and 11, 12 respectively, resulting in a mixture delay of 0.14 ms over the entire diaphragm width. This corresponds to the transit time of a sound wave from the front to the rear edge of the human ear.

Figure 3:
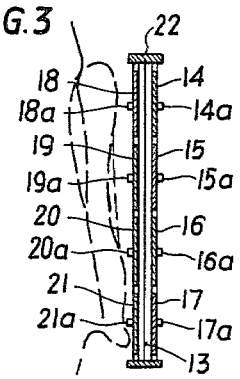
FIG. 3 is a cross-sectional top view of an electrostatic transducer according to one embodiment of the invention and arranged in relationship to the ear of a user.
Figure 4:
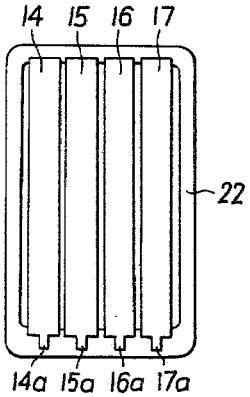
FIG. 4 is a side elevational view of the embodiment of the electrostatic transducer shown in FIG. 3.
Figure 5:
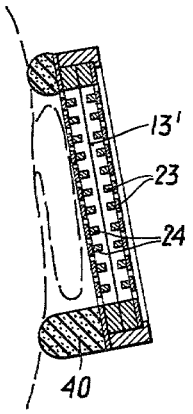
FIG. 5 is a top sectional view similar to FIG. 3 of another embodiment of the invention in which the diaphragm sections are driven orthodynamically or thadynamically.
Figure 6:
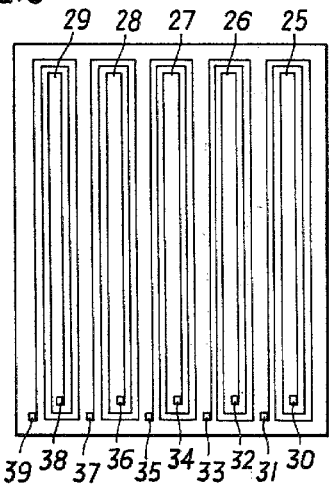
FIG. 6 is a side elevational view of the membrane used in the embodiment of FIG. 5.

FIG. 3 shows the diaphragm arrangement according to the invention in an electrostatic transducer in a use position, as viewed from the top. A diaphragm 13 is clamped under slight tension in a frame 22 between the electrodes 14 to 21 arranged in pairs. The electrical connections coordinated with each electrode pair are marked 14*a* to 21*a*. In the sense of what was said above, the electrical signal is fed to them delayed by a certain amount each. FIG. 4 is a side plan view of the electrode arrangement provided in the transducer according to FIG. 3. The electrodes are electrically insulated from each other and provided with numerous holes (not shown) to let the sound pass in as unhindered a manner as possible. One embodiment and example of the invention, in which the electroacoustical transducer works by the orthodynamic principle is shown in FIG. 5 in a top view. A thin diaphragm 13' is provided with printed conductors and clamped under slight tension between a number of magnetic pole rods 23 on the one hand and 24 on the other. The wiring of the printed embodiments on the diaphragm is shown in FIG. 6. Essentially, they represent a number of parallel flat coils 25 to 29 whose ends 30 to 39 are led to the diaphragm edge, forming electrical terminals.

Figure 7:
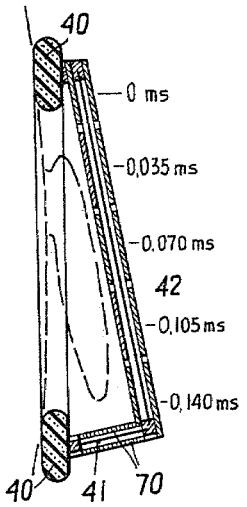
FIG. 7 is a view similar to FIG. 5 of another embodiment of the invention utilizing at least one additional diaphragm or diaphragm section.

As already mentioned at the outset, bringing about the effect according to the invention depends, among other factors, on the avoidance of sound-reflecting surfaces in the proximity of the ear entrance and/or the external ear. Embodiment examples meeting this requirement are shown schematically in section in FIGS. 7 to 9, for instance. It is provided, in the embodiment example according to FIG. 7, that the stripshaped diaphragm sections or the stripshaped part diaphragms of transducers be driven by the electrostatic principle. The diaphragm plane extends, as shown in FIG. 7, approximately parallel to an imagined plane which is tangent to the ear. This results in the distance between head and diaphragm holder in front, i.e. in the ear lobe area, being smaller than in the rear, which leads to the coupling space being wedgeshaped. Now, in order to prevent the reflection of sound waves from the coupling space wall forming the backside, this wall is replaced by an electrostatically driven diaphragm 41. The wall frame is formed by latticeshaped electrodes 70 on both sides of the diaphragm 41. This diaphragm and the adjacent stripshaped diaphragm with the electrodes 42 are operated at the maximum delay of 0.14 ms, whereas the sections or part diaphragms according to FIG. 2 operate with staggered delay. To create no additional reflecting surfaces through the ear cushion 40, it is designed here as well as in the other embodiment examples as flat as possible.

Figure 8:
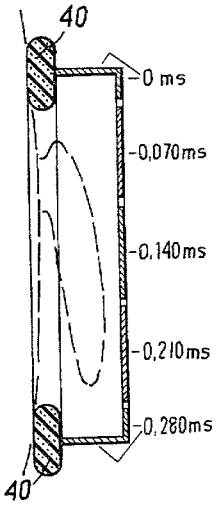
FIG. 8 is a view similar to FIG. 5 of another embodiment of the invention utilizing a coupling space in which a diaphragm is also assembled for the front of the headset.
Figure 9:
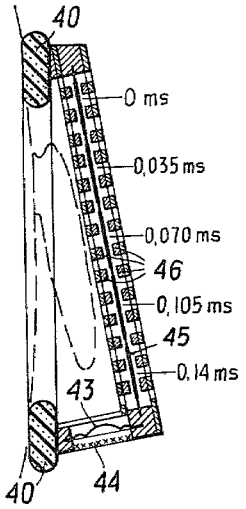
FIG. 9 is a view similar to FIG. 5 of a still further embodiment of the invention utilizing at least one passive diaphragm.

In the embodiment example shown in FIG. 8, the coupling space is roughly of canshaped or cylindrical design. This makes it possible to assemble a diaphragm also on the front side of the coupling space, i.e. in the ear lobe area, which membrane receives the signal undelayed, as does the first stripshaped diaphragm section or the first stripshaped part diaphragm. The subsequent diaphragm sections or part diaphragms receive the signal with a delay of about 0.035 ms each relative to the preceding one. As at the front of the coupling space so also at its rear a diaphragm is inserted, the delay of which amounts to about 0.28 ms versus the undelayed diaphragm. The acoustical event is so transformed by this measure as though it were perceived with enlarged external ears, making it possible to locate the sound even more drastically than usual. Another embodiment example in which the orthodynamic principle is provided for driving the active diaphragm sections or stripshaped part diaphragms is shown in FIG. 9. The diaphragm 45, divided into stripshaped sections or the stripshaped part diaphragms (not shown), are disposed between mutually parallel, magnetic pole rods 46. As before, the diaphragm sections are driven with staggered delay. The wedgeshaped coupling space is closed off in the rear not by a rigid wall, but by a passive diaphragm 43 which may be damped by a friction resistance 44. This passive diaphragm 43 makes it possible to influence the headset's frequency response. At the same time, reflections in the coupling space are suppressed by this measure. By the same token, surfaces limiting the coupling space on top and bottom in the use position of the headset can be active and/or passive diaphragms. Behind the diaphragms, as viewed from the ear, however, no reflecting surfaces should be present. Accordingly, the housing of each headset shell must be sound-permeable to a great extent, such as in the case with a wire cloth or wire mesh.

Figure 10:
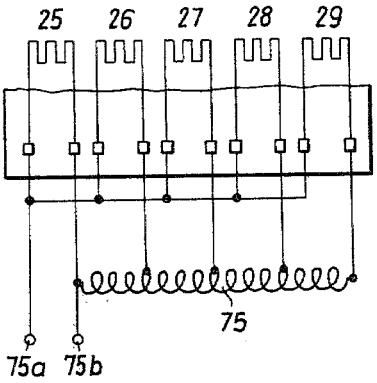
FIG. 10 is a circuit arrangement for providing a time delay in accordance with the invention utilizing an orthodynamic drive system.
Figure 11:
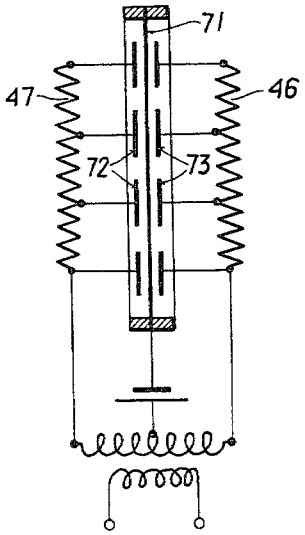
FIG. 11 is a view similar to FIG. 10 of a circuit utilized for an electrostatic system.
Figure 12:
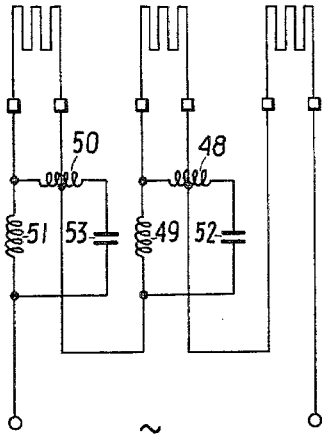
FIG. 12 is a circuit arrangement for achieving the invention providing a phase shifting effect in the form of a bridge circuit or cross circuit to produce the time delay.
Figure 13:
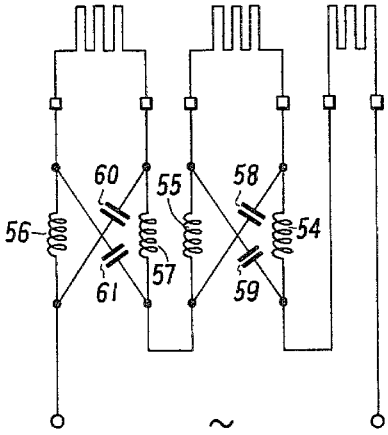
FIG. 13 is a circuit similar to FIG. 12 of another embodiment of the invention.

The operation of the diaphragm arrangement according to the invention requires transit time-delaying devices and/or circuits. One expedient possibility for an orthodynamic drive system is shown in FIG. 10. The transit time delay for the individual diaphragm sections or part diaphragms is accomplished here by means of a coil 75 provided with appropriate taps. The audio signal is applied to terminals 75*a*, 75*b*. The conductors 25 to 29 of the diaphragm sections are represented in the wiring diaphragm by ohmic resistors, which by and large corresponds to reality. The conductors 25 to 29 are connected to the taps of the coil 75 so that the stepwise delay of the signal transit time matches that of the natural one when a wave front travels across the ear from front to back. The analogous arrangement when using the electrostatic transducer principle, is shown in FIG. 11. The electrodes 72, 73 are disposed in pairs on both sides of the diaphragm plane 71. They are respectively connected to taps of the ohmic resistors 46, 47 and, due to their natural capacitance in conjunction with the ohmic resistance, they form RC circuits, same as the part sections of the coil in the previously described embodiment example formed transit-time delaying RL circuits. The amplitude weakening caused by the delay circuits can be made up for by appropriate countermeasures. For instance, when using the orthodynamic principle, the magnetic flux of the various drive systems may be varied and/or the ohmic resistance of the conductors may be different. When using the electrostatic principle, the amplitude lowering effect of the delay arrangement can be counteracted by different electrode spacings and/or different D.C. voltages. Paralleling resistors to the conductors of orthodynamic transducers or paralleling capacitances to the electrode pairs of electrostatic transducers may also be used for amplitude balancing. Apart therefrom, ohmic losses in delay circuits may be precluded to a large degree if designed as bridged circuits, cross circuits, or differential circuits. Corresponding examples are shown in FIGS. 12 and 13. In conjunction with the capacitors 52 and 53, the coils 48, 49 and 50, 51 of the circuit arrangement shown in FIG. 12 furnish an exclusively imaginary contribution to the complex damping.

The example according to FIG. 13 involves cross circuits, the coils 54, 55 and 56, 57, respectively, being arranged in their longitudinal direction while the capacitors 58, 59 and 60, 61 respectively, lie in the cross arms. Such delay arrangements may be assembled inside the headset housing as well as outside, i.e. separated from it. In addition, bucket chain memories or other digital, actively working arrangements may be employed in the diaphragm arrangement according to the invention instead of passive delay circuits.

Figure 14:
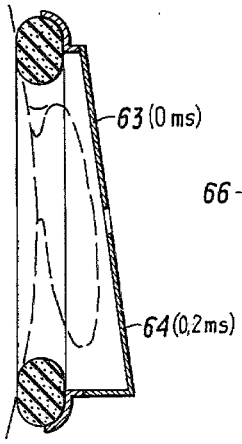
FIG. 14 is a view similar to FIG. 5 of a simplified version of the invention.

Finally, a very simple embodiment example of the invention is shown diagrammatically in FIG. 14. Replacing a larger number of stripshaped diaphragm sections or part diaphragms are here two diaphragms only. The diaphragm 63, located in front in the top view, is operated without delay whereas the diaphragm 64 disposed at an angle on the rear side of the coupling space, radiates the signal with a delay of about 0.2 ms. It is immaterial for the function of the arrangement whether the diaphragms are driven orthodynamically or electrostatically. Here too, prerequisite for the occurrence of the effect according to the invention due to the time-shifted action of the sound waves of a signal upon the external ear is the prevention of sound-reflecting surfaces in the coupling space in the proximity of the ear. To achieve good headset efficiency it is necessary to keep the coupling space as small as possible.

Figure 15:
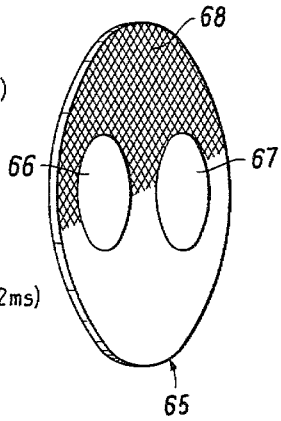
FIG. 15 is a perspective view of a disc shaped transducer used in accordance with another embodiment of the invention.
Figure 16:
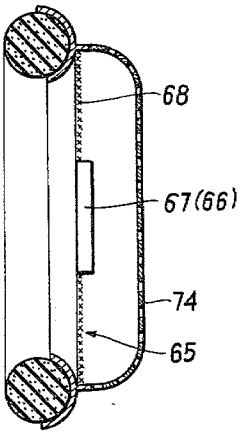
FIG. 16 is a side perspective view an embodiment of the invention utilizing the disc shaped transducer of FIG. 15.

Another simplified embodiment example is shown in FIG. 15 and FIG. 16. Assembled to a disc 65 are two preferably disc-shaped transducers 66, 67 which may be driven electrostatically, orthodynamically, piezoelectrically or by moving coil. The disc 65 is completely coated with an acoustic friction resistance 68 or forms, itself, an acoustic friction resistance by being made of sintered material, for instance. As FIG. 16 shows in section, the circumaural cushion 69 is disposed circling the disc 65. A completely perforated and therefore acoustically ineffective housing 74 provides mechanical protection and physical shape without reflecting sound waves radiated by the rear side of the transducers 66, 67. The transducer located in front relative to the external ear is operated without time delay while the transducer behind it is operated with a time delay of about 0.14 to 0.2 ms. Otherwise, the same prerequisites as described for the embodiment example according to FIG. 14 apply to this simple embodiment example of the invention as regards its perfect functioning.

While specific embodiments of the invention have been shown and described in detail to illustrate the application of the principles of the invention, it will be understood that the invention may be embodied otherwise without departing from such principles.

What is claimed is:

1. An electroacoustic headphone transducer for producing sound having discernable frontal direction and distance qualities with respect to the user comprising, means defining a diaphragm with a membrane extending in a plane and positionable in a use position in close proximity to the external ear of a user, said diaphragm means defining a diaphragm being divided into a plurality of adjacent coherent sections disposed in succession substantially along a path across the user's external ear from front to back, each section energizable by an audio signal corresponding to the sound, a support housing for supporting said diaphragm in the use position which is substantially sound permeable, and means connected to said sections for applying the audio signal to said sections, said audio signal means applying the signal to a succeeding one of said sections along said path with a delay with respect to the signal applied to a preceeding one of said sections so that said signal propagates unidirectionally from one section to a succeeding section in said path to simulate the direction quality of the sound and corresponding audio signal as it reaches the user's external ear, the sum of all such delays not exceeding 0.3 ms, there being substantially no reflecting surfaces behind said diaphragm as viewed from the user's ear.

2. An electroacoustic transducer according to claim 1, wherein said plurality of diaphragm sections are strip-shaped and disposed one next to the other.

3. An electroacoustic transducer according to claim 2, wherein each of said diaphragm sections comprises separate parts of a single diaphragm.

4. An electroacoustic transducer according to claim 2, wherein said diaphragm sections comprise a plurality of separate diaphragm parts.

5. An electroacoustic transducer according to claim 1, further including a separate areal acting drive unit for each of said diaphragm sections each connected to said means for applying the audio signal.

6. An electroacoustic transducer according to claim 1, further including at least one moving coil moving in an air gap permeated by magnetic lines of force for each of said diaphragm sections.

7. An electroacoustic transducer according to claim 1, wherein said means for applying the audio signal provides a delay for the audio signal applied to the succeeding one of said diaphragm sections is within the range of between about 0.035 ms and 0.28 ms.

8. An electroacoustic transducer according to claim 1, comprising two of said diaphragm sections, one of said diaphragm sections positionable, with the transducer in the use position, adjacent an earlobe area of the external ear of a user and the other of said diaphragm sections disposed adjacent the rear edge of the external ear of the user, the delay for the audio signal applied to the succeeding one of the diaphragm sections being in the range of between 0.14 ms to 0.2 ms.

9. An electroacoustic transducer according to claim 8, wherein said diaphragm sections adjacent the rear edge of the external ear of the user receives the signal with the delay and is disposed at an angle with respect to a tangential plane of the external ear of the user.

10. An electroacoustic transducer according to claim 1, wherein said support housing defines a cylindrical shaped coupling space when in position enclosing the user's ear, the front side of which is occupied by one of said diaphragm sections having an undelayed audio signal applied thereto, and a rear side formed another of said diaphragm sections for receiving the audio signal with delay of approximately 0.28 ms, and with a bottom formed by several additional ones of said diaphragm sections which receive the signal with a successive delay of about 0.035 to 0.07 ms from front to rear.

11. An electroacoustic transducer according to claim 1, further including at least one passive diaphragm portion for closing a coupling space with the head of the user to avoid sound reflection in the coupling space.

12. An electroacoustic transducer according to claim 1, wherein each of said diaphragm sections of a single encapsulated transducer, with the sections disposed one behind the other in said support housing.

13. An electroacoustic transducer according to claim 12, wherein said support housing comprises an acoustically ineffective frame with a friction resistance whereby reflection of sound is avoided.

14. A method of reproducing sound having a discernable front directional and distance quality, with respect to the user, with an audio signal comprising, positioning a diaphragm supported by a housing in a plane in close proximity to the external ear of a user, the diaphragm being divided into a plurality of adjacent coherent sections disposed in succession substantially along a path across the user's external ear from front to back, activating a first diaphragm section of the diaphragm along the path in alignment with the direction quality, activating a second immediately adjacent and successive diaphragm section along the path with the same audio signal which has been delayed by a selected time period, the total delay over all sections selected to be less than 0.3 ms, the housing being selected to be substantially sound permeable and there being substantially no reflecting surfaces when viewed from the user's ear behind the diaphragm, the audio signal propagating with delay unidirectionally from diaphragm section to diaphragm section along the path.

* * * * *